US011649949B2

(12) United States Patent
Goldstein et al.

(10) Patent No.: US 11,649,949 B2
(45) Date of Patent: May 16, 2023

(54) LUMINAIRES HAVING MULTIPLE LIGHTING DISTRIBUTIONS

(71) Applicant: IDEAL Industries Lighting LLC, Racine, WI (US)

(72) Inventors: Corey Goldstein, Milwaukee, WI (US); Nathan Snell, Raleigh, NC (US)

(73) Assignee: IDEAL INDUSTRIES LIGHTING LLC, Racine, WI (US)

( * ) Notice: Subject to any disclaimer, the term of this patent is extended or adjusted under 35 U.S.C. 154(b) by 0 days.

(21) Appl. No.: 17/220,294

(22) Filed: Apr. 1, 2021

(65) Prior Publication Data

US 2022/0316684 A1 Oct. 6, 2022

(51) Int. Cl.
*F21V 17/02* (2006.01)
*F21W 131/103* (2006.01)

(52) U.S. Cl.
CPC ..... *F21V 17/02* (2013.01); *F21W 2131/103* (2013.01)

(58) Field of Classification Search
CPC ..... F21V 21/14; F21V 21/26; F21V 21/28; F21V 17/02; F21S 8/086
See application file for complete search history.

(56) References Cited

U.S. PATENT DOCUMENTS 6,250,774 B1 * 6/2001 Begemann ..... F21S 8/086 362/240
6,416,207 B1 * 7/2002 Chang ..... F21V 21/26 362/418
7,810,948 B2 * 10/2010 Ogashiwa ..... F21S 8/065 362/239
7,857,497 B2 * 12/2010 Koike ..... F21V 5/04 362/545
2010/0296285 A1 * 11/2010 Chemel ..... F21V 21/00 362/249.1
2012/0236560 A1 * 9/2012 Bosch ..... F21V 5/04 362/240
2018/0328553 A1 11/2018 Lim et al.

FOREIGN PATENT DOCUMENTS

DE 102014004472 A1 10/2015
EP 2546565 A2 1/2013
EP 2644976 A1 10/2013
WO 2013058014 A1 4/2013

OTHER PUBLICATIONS

International Search Report and Written Opinion, PCT/US2022/022287, dated Apr. 14, 2022, 8 pages.
Extended European Search Report issued in application No. 20809661.0 dated Jan. 11, 2023, 8 pages.

* cited by examiner

*Primary Examiner* — Julie A Bannan
(74) *Attorney, Agent, or Firm* — J. Clinton Wimbish; Nexsen Pruet, PLLC

(57) ABSTRACT

Luminaires are described herein comprising a single fixture operable for providing multiple lighting distributions. The multiple lighting distributions can be employed for independently lighting spatially unrelated areas and/or objects in an environment. In some embodiments, a luminaire comprises a lighting assembly including a primary body providing a primary lighting distribution, and at least one secondary body extending from the primary body and providing a secondary lighting distribution. The secondary body is adjustable to at least partially orient the secondary lighting distribution outside of the primary lighting distribution.

16 Claims, 4 Drawing Sheets

LUMINAIRES HAVING MULTIPLE LIGHTING DISTRIBUTIONS

FIELD

The present invention relates to luminaires and, in particular, to luminaires employing a single fixture providing multiple lighting distributions.

BACKGROUND

Lighting fixtures, such as sidewalk, roadway and/or parking lot fixtures, often provide lighting distributions for meeting various areal lighting requirements. Lighting fixtures, for example, can provide a Type II distribution suitable for walkways, highway on-ramps and off-ramps as well as other long and narrow corridors. In other embodiments, lighting fixtures can provide a Type III distribution generally employed for roadway lighting and parking lots where a larger area of lighting is required. Alternatively, a Type V lighting distribution can be provided. Type V lighting distribution can be circular or square, having isotropic intensity over all lateral angles.

In many circumstances, it is also desirable to light surfaces and/or objects outside the general horizontal illumination plane of lighting fixtures. For example, building entrances, high security areas, and/or areas containing hazardous conditions may require lighting. Typically, lighting these areas is achieved with one or more additional luminaires. The additional luminaires can be mounted on the same post or pole as the fixture responsible for sidewalk, roadway or parking lot lighting. Alternatively, the additional luminaires can be mounted on independent supports. Use of additional luminaires for such lighting purposes can increase cost and complexity of achieving the desired lighted environment.

SUMMARY

In view of the foregoing disadvantages, luminaires are described herein comprising a single fixture operable for providing multiple lighting distributions. The multiple lighting distributions can be employed for independently lighting spatially unrelated areas and/or objects in an environment. In some embodiments, a luminaire comprises a lighting assembly including a primary body providing a primary lighting distribution, and at least one secondary body extending from the primary body and providing a secondary lighting distribution. The secondary body is adjustable to at least partially orient the secondary lighting distribution outside of the primary lighting distribution. In some embodiments, the secondary body is adjustable to fully orient the secondary lighting distribution outside of the primary lighting distribution. A luminaire, in some embodiments, comprises a plurality of secondary bodies extending from the primary body, each of the secondary bodies being adjustable to provide a secondary lighting distribution partially or fully outside of the primary lighting distribution. In some embodiments, for example, the primary body provides the primary lighting distribution for lighting a sidewalk, parking lot and/or roadway, while the secondary lighting distribution of the secondary body is employed to light an area and/or object outside the horizontal illumination plane of the primary distribution.

In another aspect, methods of lighting are described herein. In some embodiments, a method of lighting comprises providing a luminaire including a lighting assembly comprising a primary body and at least one secondary body extending from the primary body. A primary lighting distribution is provided with the primary body, and a secondary lighting distribution is provided with the secondary body. The secondary body is adjusted to at least partially orient the secondary lighting distribution outside of the primary lighting distribution. In some embodiments, the secondary body is adjusted to orient the secondary lighting distribution fully outside of the first lighting distribution.

These and other embodiments are further described in the following detailed description.

DETAILED DESCRIPTION

Embodiments described herein can be understood more readily by reference to the following detailed description and examples and their previous and following descriptions. Elements, apparatus and methods described herein, however, are not limited to the specific embodiments presented in the detailed description and examples. It should be recognized that these embodiments are merely illustrative of the principles of the present invention. Numerous modifications and adaptations will be readily apparent to those of skill in the art without departing from the spirit and scope of the invention.

I. Luminaires

In one aspect, a luminaire comprises a lighting assembly including a primary body providing a primary lighting distribution, and at least one secondary body extending from the primary body and providing a secondary lighting distribution, wherein the secondary body is adjustable to at least partially orient the secondary lighting distribution outside of the primary lighting distribution. In some embodiments, the secondary body is adjustable to fully orient the secondary lighting distribution outside of the primary lighting distribution.

Figure 1A:
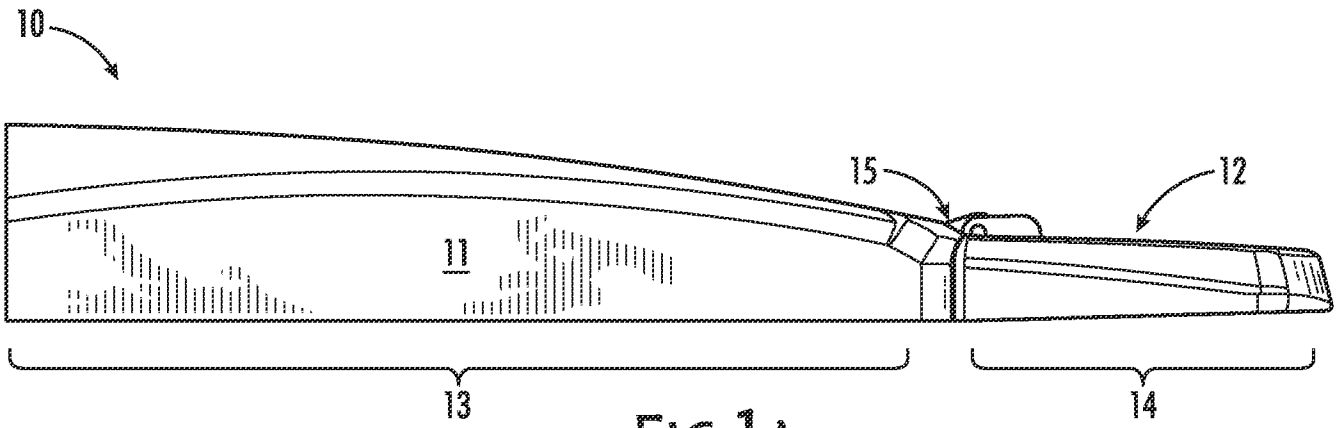
FIG. 1A illustrates a sectional elevation view of a luminaire according to some embodiments described herein.
Figure 1B:
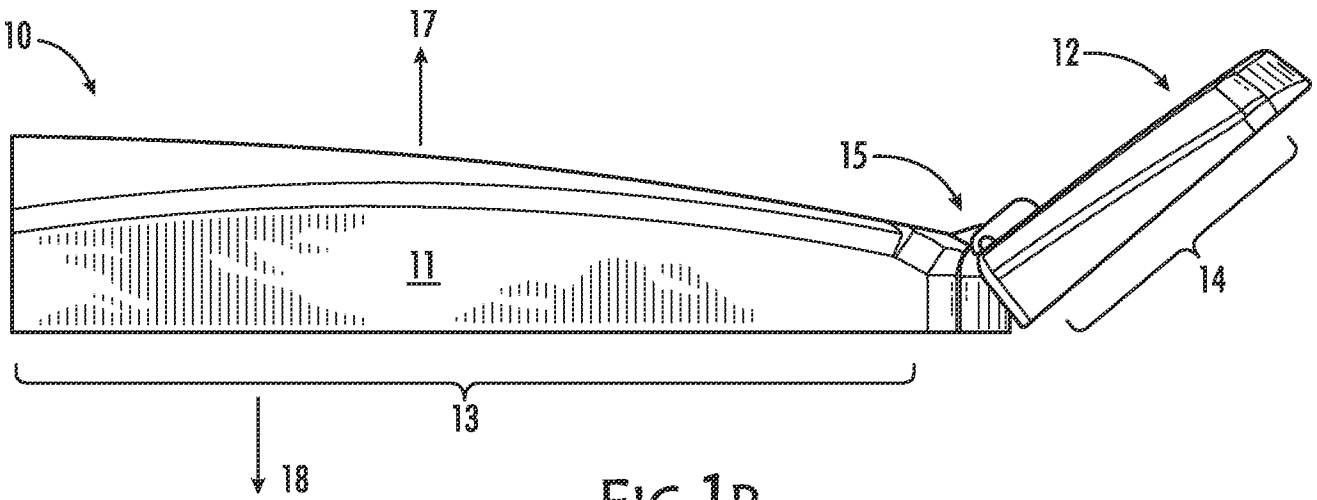
FIG. 1B illustrates the luminaire of FIG. 1A wherein the secondary body 12 has been angularly adjusted relative to the primary body 11 to at least partially orient the secondary lighting distribution outside of the primary lighting distribution.

FIG. 1A illustrates a sectional elevation view of luminaire according to some embodiments described herein. In the embodiment of FIG. 1A, the luminaire 10 comprises a primary body 11, and a secondary body 12 extending from the primary body 11. The primary body 11 comprises a light emitting face 13 for providing the primary lighting distribution. The secondary body 12 also comprises a light emitting face 14 for providing the secondary lighting distribution. The secondary body 12 is coupled to the primary body 11 via a hinge 15. The hinge 15 permits the secondary body 12 to be angularly adjustable relative to the primary body 11. In some embodiments, for example, the secondary body is adjustable at angles between nadir 18 and zenith 17 of the luminaire. FIG. 1B illustrates the luminaire of FIG. 1A wherein the secondary body 12 has been angularly adjusted relative to the primary body 11 to at least partially orient the secondary lighting distribution outside of the primary lighting distribution.

In some embodiments, the secondary lighting distribution has less than 50 percent overlap, less than 30 percent overlap, less than 10 percent overlap, or less than 5 percent overlap with the primary lighting distribution.

Turning now to specific components, the primary body comprises a light source and optic(s) for providing the primary lighting distribution. Any desired light source and optic can be employed. Specific identities of the light source and associated optic(s) can be selected according to the desired lighting characteristics and distribution. In some embodiments, the light source comprises light emitting diodes (LEDs). The LEDs can have any desired arrangement, such as arrangement in one-dimensional arrays or two-dimensional arrays. LED light sources may comprise packaged LED chip(s) or unpackaged LED chip(s). LED elements or modules can use LEDs of the same or different types and/or configurations. The LEDs, for example, can be monochromatic or any desired color combination. The LEDs can comprise single or multiple phosphor-converted white and/or color LEDs, and/or bare LED chip(s) mounted separately or together on a single substrate or package that comprises, for example, at least one phosphor-coated LED chip either alone or in combination with at least one color LED chip, such as a green LED, a yellow LED, a red LED, etc. The LED module can comprise phosphor-converted white or color LED chips and/or bare LED chips of the same or different colors mounted directly on a printed circuit board (e.g., chip on board) and/or packaged phosphor-converted white or color LEDs mounted on the printed circuit board, such as a metal core printed circuit board or FR4 board. In some embodiments, the LEDs can be mounted directly to a heat sink or another type of board or substrate. Depending on the embodiment, LED arrangements or lighting arrangements using remote phosphor technology can be employed as would be understood by one of ordinary skill in the art, and examples of remote phosphor technology are described in U.S. Pat. No. 7,614,759, which is hereby incorporated by reference.

In those cases where a soft white illumination with improved color rendering is to be produced, each LED element or module or a plurality of such elements or modules may include one or more blue shifted yellow LEDs and one or more red or red/orange LEDs as described in U.S. Pat. No. 7,213,940, which is hereby incorporated by reference. The LEDs may be disposed in different configurations and/or layouts, as desired. Different color temperatures and appearances could be produced using other LED combinations of single and/or multiple LED chips packaged into discrete packages and/or directly mounted to a printed circuit board as a chip-on board arrangement. In one embodiment, the light sources can comprise any LED, for example, an XP-Q LED incorporating TrueWhite® LED technology or as disclosed in U.S. Pat. No. 9,818,919, the disclosure of which is hereby incorporated by reference. In another embodiment, the light sources can comprise XQ-E LEDs developed by Cree, Inc.

In addition to the light source, the primary body comprises one or more optical elements. Optic(s) of the primary body can be determined according to the desired primary lighting distribution. The primary lighting distribution may be symmetric or asymmetric. Optical elements of the primary body (for example, FIG. 1A, element 13*a*), in some embodiments, can assist in providing Type II, Type III or Type V lighting distributions. Accordingly, luminaires described herein can be used in a variety of outdoor lighting applications including, but not limited to, sidewalk lighting as well as roadway and parking lot lighting. Luminaires described herein can also be employed in several indoor lighting applications. For example, a luminaire can provide illumination to narrow spaces, such as aisles, hallways and/or corners of a building or house. An optical element of the primary body, in some embodiments, can comprise a single monolithic optic covering the light source. The monolithic optic may have refractive and/or total internal reflection (TIR) surfaces, such as facets of various geometries. Alternatively, optical elements of the primary body can be localized to cover individual LEDs. In such embodiments, individual optics are provided for individual LEDs or groupings of LEDs. The individual optics can have the same architecture or architecture can vary according to position on the LED array.

The primary body can have any desired shape. The primary body, for example, can be polygonal or exhibit curvelinear surfaces. The shape of the primary body can be defined by a housing in which the light sources and optic are disposed or otherwise supported. The housing can also contain circuitry and driver hardware for the LEDs. The housing may also serve as a heat sink for the light sources. In some embodiments, the housing of the primary body can comprise fins and/or other flow through structures for cooling the light sources and associated electronics.

The secondary body extending from the primary body also comprises a light source and optic(s) for providing the secondary lighting distribution (for example, FIG. 1A, element 14*a*). Any desired light source and optic can be employed. Specific identities of the light source and associated optic(s) can be selected according to the desired lighting characteristics and distribution. In some embodiments, the light source of the secondary body comprises LEDs. The LEDs can have construction and properties described above. The secondary body can have the same or different number and/or arrangement of LEDs relative to the primary body. For example, the secondary body can have a lower number of LEDs relative to the primary body.

In addition to the light source, the secondary body comprises one or more optical elements. Optic(s) of the secondary body can be determined according to the desired secondary lighting distribution. The secondary lighting distribution may be symmetric or asymmetric. Additionally, the secondary lighting distribution can be flood distribution, in some embodiments. The flood distribution can range from 5° to 80° or 10° to 60°, in some embodiments. Optic(s) of the secondary body can be monolithic or localized to individual LEDs or groups of LEDs. As described further herein, a luminaire can comprise a plurality of secondary bodies extending from the primary body. In some embodiments, the secondary bodies have the same or similar construction to provide the same or substantially the same secondary lighting distributions. In other embodiments, the secondary bodies have differing lighting distributions tailored to different lighting environments/requirements. Moreover, the one or more secondary bodies can have construction differing from the primary body. The differing construction can enable the secondary lighting distribution to differ from the primary lighting distribution. As with the primary body, the shape of the secondary can be defined by a housing. The housing of the secondary body can extend from the housing of the primary body and have any desired shape. In some embodiments, the housing of the secondary body is polygonal or comprises curvelinear surfaces. The housing can contain the light sources, associated circuitry and electrical components of the second body. The housing can also serve as a heatsink for LED light sources and may comprise fins and/or other flow through structures for cooling the light sources and associated electronics.

The light sources of the secondary body and the primary body can be independently operable. In this way, the primary body and the secondary body can be independently illuminated. In other embodiments, the light sources of the primary and secondary bodies are not independently operable. Further, when more than one secondary body is present in the luminaire, light sources of the secondary bodies can be operated independently of one another. Alternatively, light sources of one or more subsets of the secondary bodies can be operated in concert with one another.

As described herein, the secondary body is adjustable relative to the primary body to at least partially orient the secondary lighting distribution outside of the primary lighting distribution. In some embodiments, the secondary body is adjustable to fully orient the secondary lighting distribution outside of the primary lighting distribution. The secondary body, for example, can be adjustable at angles between nadir and zenith of the luminaire. In the embodiment of FIG. 1B, the light emitting face 14 of the secondary body 12 resides at an angle greater than 90 degrees relative to nadir. In this way, the secondary lighting distribution can light surfaces and/or objects outside the horizontal illumination plane provided by the primary body 11. In some embodiments, the secondary lighting distribution has a peak intensity at an angle greater than 70 degrees, greater than 80 degrees, or greater than 90 degrees relative to nadir. Moreover, the primary lighting distribution can have a peak intensity at an angle of 5 to 60 degrees relative to nadir, in some embodiments. The light emitting face of the secondary body can proceed past zenith of the luminaire, in some embodiments, thereby forming an angle greater than 180 degrees with the nadir. In such a configuration, the secondary body can provide substantial uplighting from the secondary lighting distribution.

Figure 3A:
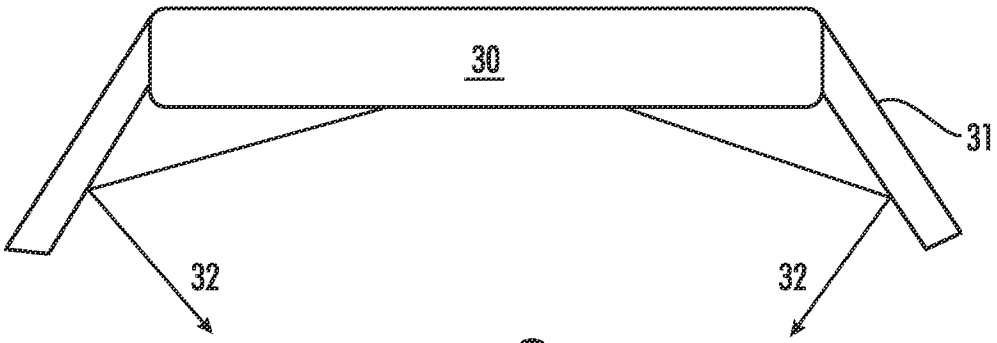
FIGS. 3A and 3B illustrate a luminaire described herein in various lighting configurations according to some embodiments.
Figure 3B:
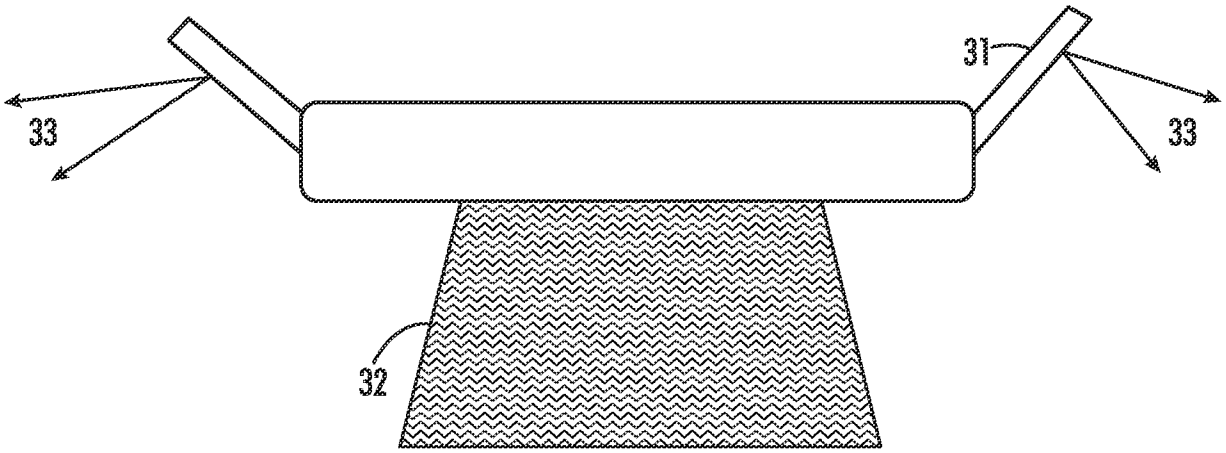
Figure 4A:
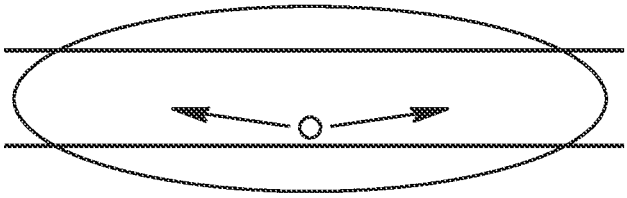
FIGS. 4A-4C illustrate Type II, Type III and Type V lighting distributions respectively.
Figure 4B:
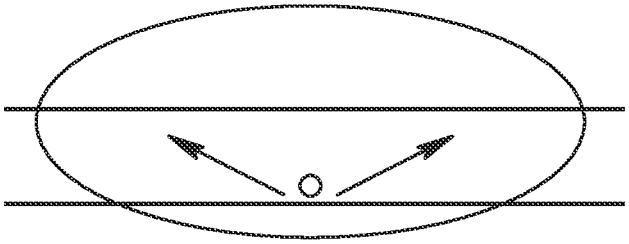
Figure 4C:
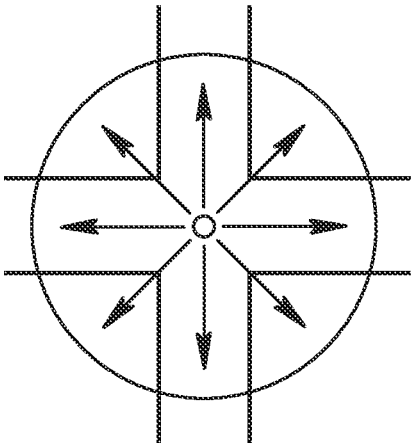

The secondary body can also serve as a cutoff structure when adjusted in a downward direction, at angles less than 90 degrees relative to nadir. In some embodiments, the secondary body is adjusted to an angle of 5 to 30 degrees relative to nadir, thereby providing a cutoff structure for the primary body. In some embodiments, the secondary body can be illuminated in a cutoff configuration, thereby adding to or altering the lighting distribution of the primary body. FIG. 3A illustrates an embodiment wherein the secondary bodies serve as a cutoff structure. In the embodiment of FIG. 3A, the secondary bodies 31 are positioned in the downward configuration, thereby serving as a cutoff structure for the primary lighting distribution 32 of the primary body 30. In contrast, the secondary bodies 31 in FIG. 3B adopt the configuration to provide the secondary lighting distribution 33 outside the primary lighting distribution 32 of the primary body 30.

In addition to being angularly adjustable, the secondary body can also be rotationally adjustable relative to the primary body, in some embodiments. The secondary body, for example, can be rotationally adjustable over the full 360 degrees. In other embodiments, the secondary body can be rotationally adjustable over less than 360 degrees, less than 270 degrees, less than 180 degrees or less than 90 degrees relative to the primary body.

Figure 2:
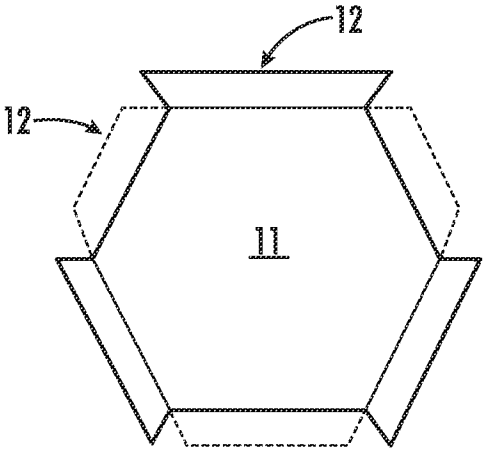
FIG. 2 illustrates top plan views of luminaires having secondary bodies at differing angular offsets according to some embodiments.
Figure 2:
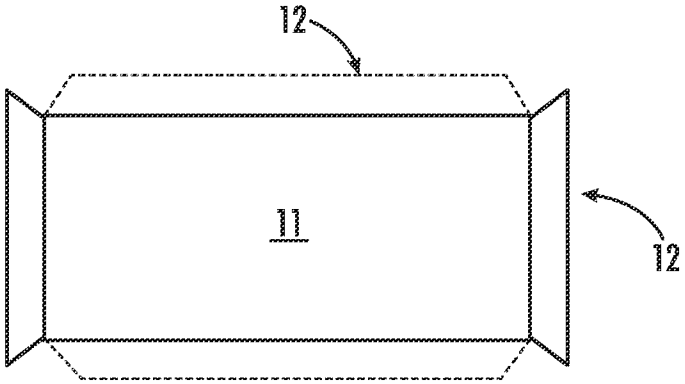

When multiple secondary bodies are present, the bodies may have the same angular and/or rotational adjustment relative to the primary body. In other embodiments, angular and/or rotational adjustment of the secondary bodies are independent of one another. Further, one or more subgroups or subsets of the secondary bodies can have the same rotational and/or angular adjustment relative to the primary body. As illustrated in FIG. 2, the secondary bodies 21 extend from the primary body 20.

When multiple secondary bodies are present, the secondary bodies can have any desired radial offset relative to one another. In some embodiments, for example, the secondary bodies are offset by 90 degrees. A 90 degree offset between the bodies can facilitate the secondary bodies lighting corners or other wall intersections. In other embodiments, the secondary bodies are offset by 180 degrees for permitting lighting in opposite directions. The secondary bodies can have any desired offset from 0 to 180 degrees. FIG. 2 illustrates top plan views of luminaires having secondary bodies 21 at differing angular offsets, according to some embodiments. The secondary bodies 21 are shown in solid and dashed lines for clarity. One, all or any subset of the secondary bodies 21 can be present on the luminaires illustrated in FIG. 2.

The second body can be coupled to the primary body in any manner consistent with achieving the technical objectives described herein. In some embodiments, the secondary body is hingedly coupled to the primary body. Alternatively, the secondary body can be coupled to the primary body via one more rods. A connector rod is adjustable at angles between nadir and zenith of the luminaire, wherein the secondary body is rotatable around the axis of the rod. In some embodiments, the secondary body is spaced from the primary body to provide a gap or aperture between the secondary body and the primary body. The aperture or gap can be of sufficient dimensions to facilitate or induce air flow through the aperture for cooling the primary body and/or secondary body. Fins and/or other heatsink structures can reside in the gap or aperture to cool the primary body and/or secondary body.

In operation, the primary body can be coupled to a mount for placement in environment to be illuminated. Any mount consistent with the technical objectives described herein can be employed. In some embodiments, for example, the mount can be a pole, post or other structure placing the luminaire at the proper elevation or height. Luminaires having architecture and properties described herein can be mounted on poles or posts for roadway, parking lot, and/or sidewalk lighting, in some embodiments. A mount for the luminaire may also be located on a wall of a building, bridge or other structure.

In various embodiments described herein various smart technologies may be incorporated in luminaires described herein, such as in sensor assembly, as described in the following applications "Solid State Lighting Switches and Fixtures Providing Selectively Linked Dimming and Color Control and Methods of Operating," application Ser. No. 13/295,609, filed Nov. 14, 2011, which is incorporated by reference herein in its entirety; "Master/Slave Arrangement for Lighting Fixture Modules," application Ser. No. 13/782,096, filed Mar. 1, 2013, which is incorporated by reference herein in its entirety; "Lighting Fixture for Automated Grouping," application Ser. No. 13/782,022, filed Mar. 1, 2013, which is incorporated by reference herein in its entirety; "Multi-Agent Intelligent Lighting System," application Ser. No. 13/782,040, filed Mar. 1, 2013, which is incorporated by reference herein in its entirety; "Routing Table Improvements for Wireless Lighting Networks," application Ser. No. 13/782,053, filed Mar. 1, 2013, which is incorporated by reference herein in its entirety; "Commissioning Device for Multi-Node Sensor and Control Networks,"" application Ser. No. 13/782,068, filed Mar. 1, 2013, which is incorporated by reference herein in its entirety; "Wireless Network Initialization for Lighting Systems," application Ser. No. 13/782,078, filed Mar. 1, 2013, which is incorporated by reference herein in its entirety; "Commissioning for a Lighting Network," application Ser. No. 13/782,131, filed Mar. 1, 2013, which is incorporated by reference herein in its entirety; "Ambient Light Monitoring in a Lighting Fixture," application Ser. No. 13/838,398, filed Mar. 15, 2013, which is incorporated by reference herein in its entirety; "System, Devices and Methods for Controlling One or More Lights," application Ser. No. 14/052,336, filed Oct. 10, 2013, which is incorporated by reference herein in its entirety; and "Enhanced Network Lighting," application Ser. No. 61/932,058, filed Jan. 27, 2014, which is incorporated by reference herein in its entirety.

II. Methods of Lighting

In another aspect, methods of lighting are described herein. In some embodiments, a method of lighting comprises providing a luminaire including a lighting assembly comprising a primary body and at least one secondary body extending from the primary body. A primary lighting distribution is provided with the primary body, and a secondary lighting distribution is provided with the secondary body. The secondary body is adjusted to at least partially orient the secondary lighting distribution outside of the primary lighting distribution. In some embodiments, the secondary body is adjusted to orient the secondary lighting distribution fully outside of the first lighting distribution. The luminaire van be mounted on a pole, post or other structure placing the luminaire at the proper elevation or height. Luminaires employed in the present methods can have any architecture and/or properties described in Section I above.

In some embodiments, the primary lighting distribution is a horizontal distribution normal or substantially normal to nadir, whereas the secondary distribution is outside the primary lighting distribution. In this way, roadways, parking lots, sidewalks and other areal/ground surfaces can be illuminated while also illuminating surfaces extending in the vertical direction, including building entrances, walls and/or fences with a single integrated fixture.

Various embodiments of the invention have been described in fulfillment of the various objectives of the invention. It should be recognized that these embodiments are merely illustrative of the principles of the present invention. Numerous modifications and adaptations thereof will be readily apparent to those skilled in the art without departing from the spirit and scope of the invention.

The invention claimed is:

1. A luminaire comprising:

a lighting assembly comprising a primary body providing a primary lighting distribution selected from the group consisting of a Type II, Type III and Type V lighting distribution, and at least one secondary body extending from the primary body and providing a secondary lighting distribution differing from the primary lighting distribution, wherein the secondary body is smaller than the primary body and is adjustable to fully orient the secondary lighting distribution outside of the primary lighting distribution, wherein the primary body and the secondary body each comprise a light source and optic over the light source, the optic of the primary body differing from the optic of the secondary body, the optic of the primary body comprising optical elements providing the primary lighting distribution, and the optic of the secondary body comprising optical elements providing the secondary lighting distribution.

2. The luminaire of claim 1, wherein the secondary body is angularly adjustable relative to the primary body.

3. The luminaire of claim 2, wherein the secondary body is adjustable at angles between nadir and zenith of the luminaire.

4. The luminaire of claim 3, wherein the secondary body forms an angle with nadir greater than 90 degrees.

5. The luminaire of claim 3, wherein the secondary lighting distribution has a peak intensity at an angle greater than 80 degrees relative to nadir.

6. The luminaire of claim 3, wherein the secondary lighting distribution has a peak intensity at an angle greater than 90 degrees relative to nadir.

7. The luminaire of claim 3, wherein the primary lighting distribution has a peak intensity of 5 to 60 degrees relative to nadir.

8. The luminaire of claim 1, wherein the secondary body is rotationally adjustable relative to the primary body.

9. The luminaire of claim 1, wherein the secondary body is angularly and rotationally adjustable relative to the primary body.

10. The luminaire of claim 1, wherein the optic of the secondary body provides an asymmetric secondary lighting distribution.

11. The luminaire of claim 1, wherein the secondary body follows a tapering profile of the primary body.

12. The luminaire of claim 1, wherein the primary lighting distribution is a Type II, or Type III lighting distribution.

13. The luminaire of claim 1, wherein the luminaire is a roadway luminaire or parking lot luminaire.

14. A luminaire comprising:

a lighting assembly comprising a primary body providing a primary lighting distribution selected from the group consisting of a Type II and Type III lighting distribution, and at least one secondary body extending from the primary body and providing a secondary lighting distribution differing from the primary lighting distribution, wherein the secondary body is adjustable to fully orient the secondary lighting distribution outside of the primary lighting distribution, wherein the primary body and the secondary body each comprise a light source and optic over the light source, the optic of the primary body differing from the optic of the secondary body, the optic of the primary body comprising optical elements providing the primary lighting distribution, and the optic of the secondary body comprising optical elements providing the secondary lighting distribution.

15. A luminaire comprising:

a lighting assembly comprising a primary body providing a primary lighting distribution selected from the group consisting of a Type II, Type III and Type V lighting distribution, and at least one secondary body extending from the primary body and providing an asymmetric secondary lighting distribution differing from the primary lighting distribution, wherein the secondary body is adjustable to fully orient the secondary lighting distribution outside of the primary lighting distribution, wherein the primary body and the secondary body each comprise a light source and optic over the light source, the optic of the primary body differing from the optic of the secondary body, the optic of the primary body comprising optical elements providing the primary lighting distribution, and the optic of the secondary body comprising optical elements providing the secondary lighting distribution.

16. A luminaire comprising:

a lighting assembly comprising a primary body providing a primary lighting distribution selected from the group consisting of a Type II, Type III and Type V lighting distribution, and at least one secondary body extending from the primary body and providing a secondary lighting distribution differing from the primary lighting distribution, wherein the secondary body is adjustable to fully orient the secondary lighting distribution outside of the primary lighting distribution, wherein the primary body and the secondary body each comprise a light source and optic over the light source, the optic of the primary body differing from the optic of the secondary body, the optic of the primary body comprising optical elements providing the primary lighting distribution, and the optic of the secondary body comprising optical elements providing the secondary lighting distribution, wherein the luminaire is a roadway luminaire or parking lot luminaire.

* * * * *